United States Patent [19]

Hughes et al.

[11] Patent Number: 4,967,639

[45] Date of Patent: Nov. 6, 1990

[54] RAPID BURST FIRING ELECTROMAGNETIC LAUNCHER

[75] Inventors: William F. Hughes, Cambridge Springs; George A. Kemeny, Wilkins Twp.; Frederick J. Young, State College, all of Pa.

[73] Assignee: Westinghouse Electric Corp., Pittsburgh, Pa.

[21] Appl. No.: 398,539

[22] Filed: Jul. 15, 1982

[51] Int. Cl.[5] ..... F41B 6/00

[52] U.S. Cl. ..... 89/8; 124/3; 310/13

[58] Field of Search ..... 89/8; 124/3; 310/10–14; 318/135

[56] References Cited

U.S. PATENT DOCUMENTS

| | | | |
|---|---|---|---|
| 4,347,463 | 8/1982 | Kemeny et al. | 89/8 X |
| 4,369,692 | 1/1983 | Kemeny | 89/8 |
| 4,423,662 | 1/1984 | McAllister | 89/8 |
| 4,429,612 | 2/1984 | Tidman et al. | 89/8 |
| 4,432,333 | 2/1984 | Kurherr | 89/8 X |
| 4,433,608 | 2/1984 | Deis et al. | 89/8 |
| 4,437,383 | 3/1984 | Deis et al. | 89/8 |

*Primary Examiner*—Stephen C. Bentley
*Attorney, Agent, or Firm*—R. P. Lenart

[57] ABSTRACT

A multiple bore electromagnetic projectile launcher is provided with series circuit elements connected to the muzzle end of conductive rails of a bore to continue current conduction in those rails following the launch of a projectile and during the launch of a successive projectile. This current flow augments the flux in the successive bore during the launching of a successive projectile. Individual firing switches can be provided for each bore or additional conductive rails can be provided in an automatic switching arrangement to conduct current from a muzzle of a fired bore to the breech of a successive bore.

41 Claims, 3 Drawing Sheets

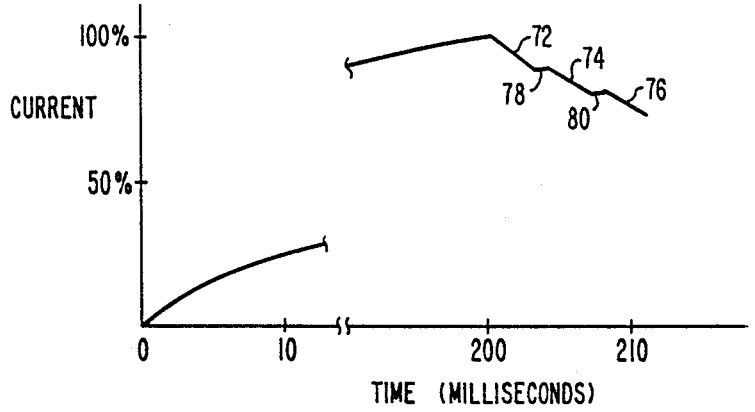
FIG. 4
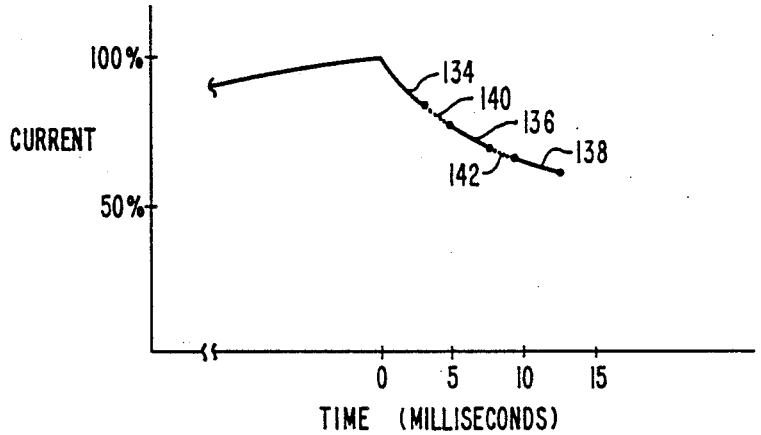
FIG. 7
FIG. 8
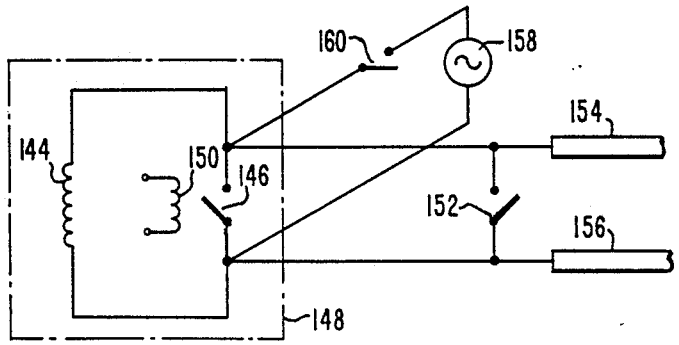

RAPID BURST FIRING ELECTROMAGNETIC LAUNCHER

BACKGROUND OF THE INVENTION

This invention relates to electromagnetic projectile launchers and more particularly to multiple bore launchers in which the conductors of a fired bore serve as augmenting conductors for subsequently fired bores in order to maintain a substantially constant muzzle velocity for each successively fired projectile as the firing current decreases.

Rapid firing electromagnetic projectile launcher systems have been proposed in which kinetic energy is stored by revving up a rotor of a kinetic energy storing generator. A fraction of this stored energy is then delivered for each acceleration of a projectile in such a manner that the firing current remains consistent for each shot, thus resulting in a uniform projectile muzzle velocity. Two types of systems have been deemed feasible, one involved a homopolar-inductor combination and the other a rotating pulse generator.

In the homopolar-inductor system, a homopolar generator charges an inductor to the firing current level, and suitable switching fires a projectile. This type of operation is described in commonly assigned copending application Ser. No. 256,745, filed Apr. 23, 1981, where some or all of the inductive storage is provided by bore flux augmenting conductors.

With the rotating pulse generator system, the generator produces distinct voltage pulses. In its simplest version, such a generator is connected to the breech rail terminals and, if the breech electrical loop is shorted by the presence of a projectile package, that projectile will be fired because the voltage pulse in combination with all the circuit and projectile-rail parameters results in the desired and consistent accelerating current variation. Barrel and bore configurations particularly suitable for use with a pulse generator are disclosed in commonly assigned copending application Ser. No. 256,745, filed Apr. 23, 1981.

Both the homopolar-inductor and the pulse generator systems have the desirable feature of being able to store sufficient kinetic energy for many shots in a relatively compact, rotating generator. They both suffer the disadvantage that fully charging the rotating machine with sufficient energy for a maximum length burst may take two or three minutes and thus, for immediate fire capability, in a battle tank for example, the rotating machinery may have to remain revved up for hours, though not necessarily at the full speed and hence full kinetic energy level. A further drawback of both systems is that the firing rate will tend to decrease for successive shots, though this can be improved by auxiliary equipment or circuitry. In addition, both systems have high stator reaction torques during inductor discharging or firing. Although this can be alleviated by using two counter-rotating rotors for the kinetic energy storage generator, this in turn increases the generator size, weight and cost and complicates the system for accelerating the rotors.

The present invention includes an inductive store and barrel system combination wherein the energy for launching a succession of shots is delivered directly by the inductive store without necessarily supplying any additional energy to that inductive store during the burst sequence. For example, the inductive store may, in the conventional manner, be charged to the desired first shot current level by a homopolar or other type of dc pulse generator and that generator may also remain connected to the inductive store during the firing sequence and thus may even continue to supply some additional energy during the burst. However the generator does not and normally cannot supply sufficient energy to maintain anywhere near constant current for very rapid successive launchings. The inductor-barrel system combination of this invention will result in a significant decrease in average launching current for each successive shot of a burst, while maintaining substantially constant muzzle velocity for each projectile of the burst.

The instantaneous accelerating force on a projectile in a parallel rail electromagnetic launcher is equivalent to $\frac{1}{2}L'I^2$, where $L'$ is the barrel inductance gradient and I is the driving current. The average accelerating force in the bore, assuming $L'$ to be constant from breech to muzzle, is then $\frac{1}{2}L'I^2_{RMS}$. If the current decreases for successive shots, $L'$ must then be made to correspondingly increase because the requirement of maintaining constant exit velocity can only be met by keeping the product $L'I^2_{RMS}$ constant for successive shots. Although this constant muzzle velocity requirement can also be met by changing the barrel length or projectile weight for successive shots, neither of these alternatives appears practical. Thus it is required to increase $L'$ for successive shots. In the present invention, this is accomplished by maintaining current flow in each previously fired bore and letting that current flow sufficiently augment the bore flux for successive shots, thereby providing the correct increase in inductance gradient $L'$ to yield the same driving force at the now lower value of $I^2_{RMS}$. This operating scheme thus requires a number of bores equal to the maximum number of shots in a burst and the conductors of the first firing bore must continue to conduct current during the burst sequence. To prevent energy wastage and overheating of bore conductors, the burst firing should be extremely rapid with the interval between exit of one projectile and commencing acceleration of the successive one being preferably only or even less than one or two milliseconds. In accordance with this invention, the firing of each successive shot may be initiated by suitable switching or, alternatively, successive firing may be self initiated or self switched.

Launchers constructed in accordance with the present invention possess the important feature that all energy for a burst can be inductively stored. When a normally conducting inductor coil is used, charging that inductor to the required current level can be performed by a pulse dc generator, and this charging, which should take a fraction or in the order of a second, must absolutely be performed immediately prior to firing. However, if superconducting inductive storage is employed, the launch energy can be effectively stored for very long periods of time without energy addition, without high velocity rotating machinery, and during the firing, no reaction forces due to generator rotor torque will be produced. The size of a suitable superconducting inductive store is well under, on an energy stored basis, the size and weight of a kinetic energy storing generator together with its normally conducting inductive storage coil.

SUMMARY OF THE INVENTION

A switched electromagnetic projectile launcher constructed in accordance with the present invention comprises: a first pair of conductive rails, having a breech end and a muzzle end; a second pair of conductive rails, having a breech end and a muzzle end; a source of high current; a first switch for commutating current from the high current source to the first pair of rails; means for conducting current between the first pair of rails and for propelling a first projectile from the breech end to the muzzle end of the first pair of rails; means for connecting the first pair of rails in series with the high current source; a second switch for commutating current from the series connection of the high current source and the first pair of rails to the second pair of rails; and means for conducting current between the second pair of rails and for propelling a second projectile from the breech end to the muzzle end of the second pair of rails. Alternatively, a self switched electromagnetic projectile launcher constructed in accordance with the present invention comprises: a first pair of conductive rails having a breech end and a muzzle end; a second pair of conductive rails having a breech end and a muzzle end; a source of high current; a switch for commutating current from the high current source to the first pair of rails; means for conducting current between the first pair of rails and for propelling a first projectile from the breech end to the muzzle end of the first pair of rails; a third pair of conductors or conductive rails electrically connected to the second pair of rails and disposed adjacent to the second pair of rails so that current in adjacent conductors of the second and third pairs flows in the same direction; means for connecting the first pair of rails in series with the third pair of rails; and means for conducting current between the second pair of rails and for propelling a second projectile from the breech end to the muzzle end of the second pair of rails. Both the switched and the self switched electromagnetic projectile launcher employ the same method of accelerating projectiles which comprises the steps of: charging an inductive energy store to a predetermined current; commutating the current into a first pair of rails to launch a first projectile; connecting the first pair of rails in series with the inductive energy store; and commutating current from the series connection of the inductive energy store and the first pair of rails, into a second pair of rails to launch a second projectile. During the launch of the second projectile, current flow in the first pair of rails augments flux between the second pair of rails to provide for a constant muzzle velocity for successive shots while launch current decreases. In the self switched launcher, the third pair of rails acts as augmenting conductors for the second pair of rails. Both the switched and the self switched launchers can include additional augmenting conductors which reduce the amount of current decrease for successive shots.

BRIEF DESCRIPTION OF THE DRAWINGS

FIG. 4 is a graph illustrating the current flowing in the launcher of FIG. 1 during a launching sequence;

FIG. 7 is a graph of the current flowing in the launcher of FIG. 5 during a launch sequence; and FIG. 8 is a schematic drawing of a superconducting inductive energy store for use with the electromagnetic launchers of FIG. 1 or FIG. 5.

DETAILED DESCRIPTION OF THE PREFERRED EMBODIMENT

Figure 1:
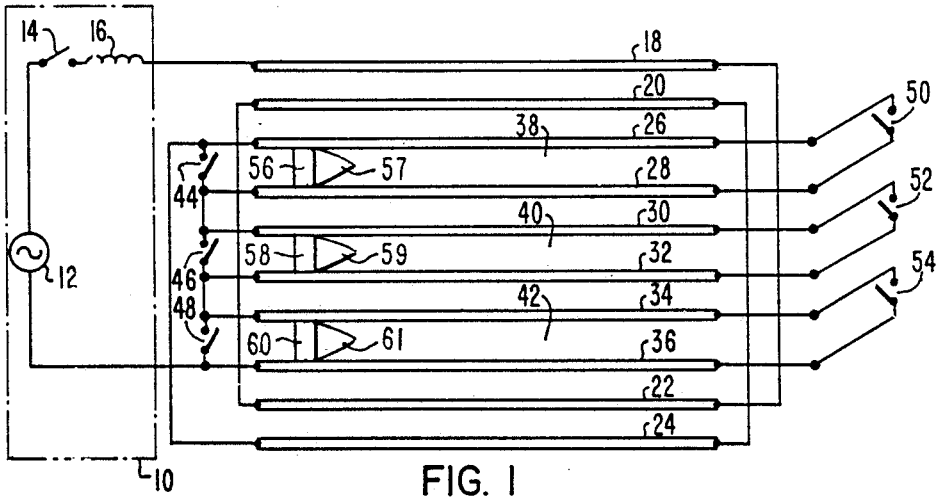
FIG. 1 is a schematic representation of a switched electromagnetic projectile launcher in accordance with one embodiment of the present invention.

Referring to the drawings, FIG. 1 is a schematic representation of a switched electromagnetic projectile launcher in accordance with one embodiment of the present invention. A source of high current 10 comprising, for example, the series connection of a direct current generator 12, a switch 14 and an inductor 16, is connected to a double augmented three bore rail system. Augmenting conductors 18, 20, 22 and 24 are generally parallel to conductive rails 26 and 28, 30 and 32, and 34 and 36, which form bores 38, 40 and 42 respectively. The augmenting conductors and projectile launching rails are connected such that adjacent conductors and rails conduct current in the same direction during a launch. Firing switches 44, 46 and 48 are connected across the breech end of the conductive rails forming bores 38, 40 and 42 respectively. Circuit series elements 50, 52 and 54 are connected between the muzzle ends of the conductive rails forming bores 38, 40 and 42 respectively.

When the launcher of FIG. 1 is about to commence firing, firing switches 44, 46 and 48 are closed, and series circuit elements 50, 52 and 54 are open. Generator 12, which may be a pulse homopolar generator, is revved up and switch 14 is closed, to supply current which flows in series through inductive energy store 16 and augmenting conductors 18, 20, 22 and 24. When a predetermined firing current level has been achieved, firing switch 44 is opened, commutating current into conductive rails 26 and 28 of bore 38. Armature 56, which may be a sliding conductor or a plasma, serves as means for conducting current between conductive rails 26 and 28 and for propelling a projectile 57 from the breech end to the muzzle end of bore 38. After projectile 57 has been launched from bore 38, series circuit element 50 provides a means for shorting the muzzle end of conductive rails 26 and 28 to maintain current flow through these rails. Series circuit element 50 which only becomes conducting after being suitably triggered, and thereafter remains conducting at a low voltage drop, until current flow stops, may be an arc gap, lightening arrestor or suitably triggered solid state device or an array of such devices. To fire a second projectile 59, firing switch 46 is opened, thereby commutating current to conductive rails 30 and 32 and through conductive armature 58. During the launch of the second projectile, current flowing through conductive rails 26 and 28 serves to augment the flux in bore 40 so that the acceleration of the second projectile is quite closely equal to the acceleration of the first projectile, even though the current level has decreased as a result of firing the first projectile. After the second projectile is fired, series circuit element 52 acts as means for shorting conductive rails 30 and 32 at the muzzle and the conductive rails of bores 38 and 40 act as augmenting rails for bore 42 when firing switch 48 is opened, thereby commutating current into conductive rails 34 and 36 and conductive armature 60 to launch a third projectile 61 from bore 42.

Figure 2:
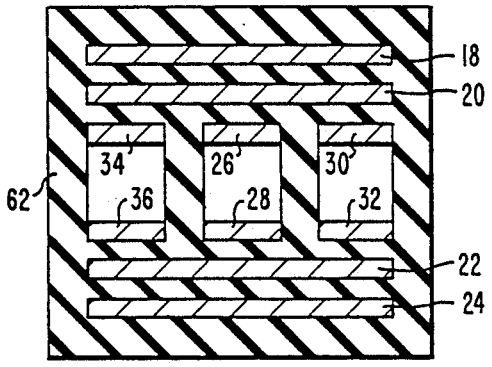
FIG. 2 is a cross sectional view of the launcher of FIG. 1.

FIG. 2 is a cross sectional view of the launcher of FIG. 1. This drawing illustrates a feasible relative location of augmenting conductors 18, 20, 22 and 24 as well as projectile launching rails 26, 28, 30, 32, 34 and 36 in order to achieve the appropriate flux augmentation for successive projectile launchings. Insulating structure 62 in conjunction with additional restraining means, not shown, serves to hold the rails in position.

Figure 3:
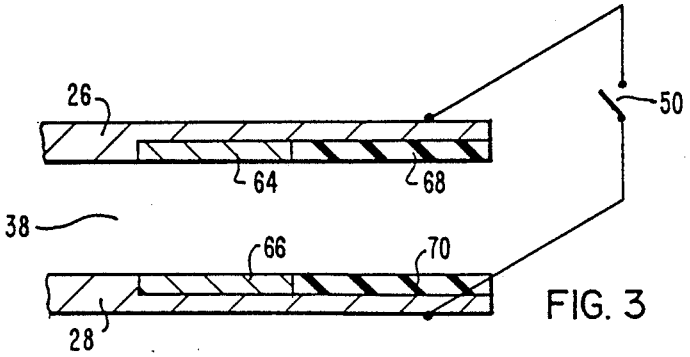
FIG. 3 is a detail view of the end section of one pair of launcher rails in the launcher of FIG. 1.

The series circuit elements 50, 52 and 54 of the launcher of FIG. 1 in each muzzle bridging circuit are required so that parallel current loops formed by individual firing switches, bore rails and muzzle bridging means remain open during inductor charging as such loops, or even a single one, if closed during charging would represent a short circuited transformer secondary and would result in enormous energy wastage or inability to charge to the required current level. If inductive storage means 16 is charged by a homopolar generator, the maximum voltage level likely to appear across the muzzle circuit series elements during charging will be well below one half of the homopolar generator voltage. During the firing sequence, the series circuit elements need to become conducting only when the projectile exits from the bore. Breakdown of the series circuit elements into the conducting mode can be assured and correctly timed by deliberately introducing a temporary voltage increase or pulse while the projectile exits from the bore. FIG. 3 illustrates a projectile launching rail structure which will produce a temporary voltage increase or pulse while the projectile exits. High resistivity rail inserts 64 and 66 and insulation 68 and 70 are disposed along an inner surface of projectile launching rails 26 and 28. As the projectile armature passes the high resistivity inserts and insulation, a voltage rise appears near the muzzle end of rails 26 and 28 which is sufficient to cause series circuit element 50 to begin conducting. The high resistivity rail inserts and insulation can be used separately or in combination to achieve the desired voltage rise. After a projectile exits from bore 38, the muzzle bridging circuit of that bore allows current flow to continue and that current flow augments the flux for the successive bores. The firing switch of the next bore is then opened immediately after exit of the first projectile and this procedure is continued through all bores or aborted by either failing to open the successive firing switch or by additionally dissipating the remaining inductive energy in a crow bar loop.

Table I gives rough estimates, under very simplified and idealized conditions, of the RMS current levels required for successive bores in order to maintain constant exit velocity for the series of projectiles.

TABLE I

SWITCHED LAUNCHER FIRING DATA
Estimate of RMS Launch Current Required to Obtain Uniform Exit Velocity

| Configuration | First Bore Un-augmented | First Bore Once Augmented | First Bore Twice Augmented | First Bore Thrice Augmented |
|---|---|---|---|---|
| First Bore | 100% | 100% | 100% | 100% |
| Second Bore | 57.7 | 77.5 | 84.5 | 88.2 |
| Third Bore | 44.7 | 65.5 | 74.5 | 79.8 |
| Fourth Bore | 37.8 | 57.7 | 67.4 | 73.4 |
| Fifth Bore | 33.3 | 52.2 | 62.0 | 68.3 |

With the first bore unaugmented, the drastic change in the current level required between the first and second shots makes this configuration unattractive, that is, an external inductor which stores enough energy for six shots, for example, will not result in the required large current drop after the first shot. This same reasoning is also expected to make the first bore once augmented configuration unattractive in that the current reduction between first and second shots is still far larger than for successive ones. More practical configurations are illustrated by the next two columns. Furthermore the 100% current levels for these configurations are well below the corresponding levels required for the first shot in the first bore once augmented or unaugmented cases. For example, it is estimated that if the RMS current has to be 400 kiloamps for the first bore in an unaugmented case, it need only be about 180 kiloamps if the first bore is twice augmented or 150 kiloamps if thrice augmented.

Sizing the external inductive energy store to meet the required RMS current reductions for successive shots will be relatively simple. The first shot requirement will yield the initial current level for the first bore. If the external inductive storage is then insufficient, successive shots will have inadequate current levels and hence lower than desired velocities. If the inductive energy storage is excessive, the velocity of successive shots will increase, which is also but less undesirable. The best compromise is to use a somewhat excessive inductive energy storage. Then the interval between the exit of one shot and commencing firing the next one can be adjusted and programmed to dissipate enough energy to decrease the current precisely to the level desired for the successive shot.

If the projectiles are propelled by a metallic conducting armature, the muzzle voltage during projectile acceleration will be on the order of a few volts and current flow past the projectile will be prevented because the muzzle circuit series elements is still in its open circuit mode. For plasma drive, the muzzle voltage during acceleration can easily reach a few hundred volts and the muzzle circuit series element must then have a higher breakdown voltage so that it becomes conducting only when it sees additional voltage generated by, for example, the FIG. 3 muzzle elements.

In the launcher of FIG. 1, there is likely to be a low voltage drop of up to about one volt across each of the closed firing switches prior to firing and this could cause premature heating or movement of a conducting armature driven projectile or, in the case of plasma drive, premature heating of for example an exploding fuse wire. Such premature heating or movement may be prevented by resistive inserts in the breech, by only inserting the projectile when firing is to commence, by a thin insulating film on the armature contact surfaces which only breaks down at a few tens of volts or by other means.

FIG. 4 is a graph of the estimated current versus time for the launcher of FIG. 1 having the conductor rail configuration of FIG. 2, under the assumption that charging to the initial firing current level is accomplished by a homopolar generator. In a launcher which utilizes switches for firing successive bores, there is no change in the total inductance between the time when one projectile exits and the time when the next one starts to be accelerated. This is why, in FIG. 4, the exit or muzzle current for the previous projectile essentially matches the initial breech current for the successive one. In FIG. 4, line segments 72, 74 and 76 represent current flow during the launching of three projectiles, while line segments 78 and 80 represent the switching intervals between the exit of one projectile and the start of the acceleration of the succeeding projectile.

Figure 5:
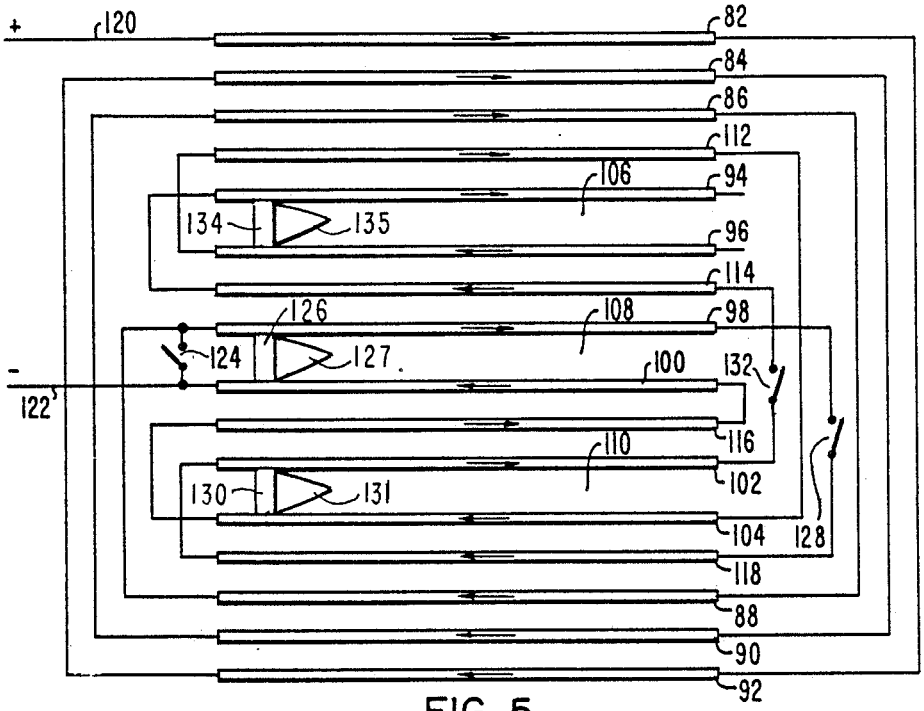
FIG. 5 is a schematic representation of the conductive rail assembly in a self switched electromagnetic projectile launcher in accordance with one embodiment of the present invention.

FIG. 5 is a schematic representation of the conductive rail assembly for a thrice augmented self switched electromagnetic projectile launcher in accordance with one embodiment of the present invention. Conductors 82, 84, 86, 88, 90 and 92 serve as augmenting conductors for three pairs of projectile launching rails and are connected to conduct current during a launch in the same direction as the closest launching rail in each pair. Projectile launching rails 94 and 96, 98 and 100, and 102 and 104 are disposed adjacent bores 106, 108 and 110 respectively. Conductors 112 and 114 serve as additional augmenting conductors and also conduct current to bore 106, and conductors 116 and 118 serve as additional augmenting conductors and also conduct current to bore 110. The conductive rail assembly receives high current from a high current source such as 10 in FIG. 1, on bus bars 120 and 122. Firing of a projectile 127 along bore 108 can be initiated by opening firing switch 124. If a different pulse power supply is used, firing can be initiated by merely inserting conductive armature 126 into the bore. As the first projectile reaches the muzzle end of bore 108, muzzle series circuit element 128 becomes conductive and muzzle voltage commutates the current into conductive rails 102 and 104 and conductive armature 130, to accelerate a second projectile 131 along bore 110. As this projectile reaches the muzzle of bore 110, muzzle series circuit element 132 becomes conductive and muzzle voltage commutates the current to flow through rails 112 and 114 into rails 94 and 96 and conductive armature 134, to accelerate a third projectile 135 along bore 106. Thus in the self switched configuration, after the first shot, the conductive rails at the muzzle of the first projectile bore are electrically connected to the breech conductors of the next successive bore in such a manner that the muzzle to breech conductors also act as flux augmenting conductors for the successive bore and, for all successive bores, though obviously they will most efficiently augment the bore to which they are most closely spaced. In this self switched launcher, after the first shot, each successive bore is thus not only augmented by the current flowing through the previously fired bore rails but also by the pair of conductors which conduct current to the breech from the previously fired muzzle. In essence, the projectile being accelerated, more obviously so when a conductive armature is used, limits the muzzle voltage for successive projectiles to a voltage which has to be low enough to prevent premature acceleration of the successive projectile in the next successive bore. If plasma drive is used, the muzzle voltage would be excessive and for prevention of premature and parasitic effects on the next successive bore bridging conductor, series circuit elements similar to the muzzle circuit elements as described for the launcher of FIG. 1 must be used. These series elements are also required to prevent parasitic losses during inductor charging. The series devices, during firing, prevent current flow to the successive projectile until the preceding projectile has about exited and again, a FIG. 3 type configuration can be used to give a voltage rise to trigger conduction of the series circuit elements.

In a self switched launcher, during or immediately after exiting of a projectile and before acceleration of the next projectile at total available system current, essentially two circuit changes must simultaneously occur. These are: one, the current must be induced to flow in the additional loop consisting of the muzzle to breech conductors, for example 112 and 114 in FIG. 5, which loop is shorted by a projectile armature or shooting wire in the next successive breech and two, the total current level has to drop somewhat because, between shots, the total system inductance has increased due to the additional inductance of the muzzle to breech conductors but the total energy has not increased. Both of these transient changes occur before the next successive projectile is accelerated at system current and these changes should therefore be expedited because flow of current during the time when little acceleration occurs obviously results in undesired resistive energy losses. The rapidity with which these transient changes occur can be increased by increasing the voltage which drives these changes and therefore for the self switched launcher, the muzzle voltage during exiting of the projectile should be increased, for example, by lengthening the FIG. 3 configuration and increasing its impedance to yield a higher voltage for a longer period of time. Thus for the switched launcher, the FIG. 3 muzzle configuration was primarily introduced for the rather minor duty of correctly triggering the conducting mode of the muzzle circuit series elements. For the self switched launcher, the FIG. 3 device is additionally employed to produce adequate voltage, during the exiting of a projectile, to rapidly complete the transients which delay attainment of full current for accelerating the next successive projectile.

Figure 6:
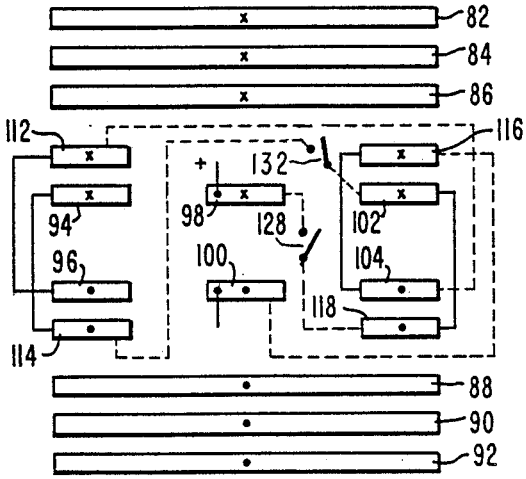
FIG. 6 is an end view of the launcher of FIG. 5 showing the breech and muzzle connections.

FIG. 6 shows an end view of the conductive rail array of a three bore, initially thrice augmented, self switched launcher of FIG. 5, looking into the breech end. The electrical connections at the breech end are indicated by solid lines while the connections at the muzzle end are shown as dotted lines. Table II lists rough estimates of the successive RMS current requirements for equal muzzle velocity projectiles based on highly simplified calculations for the self switched launcher of FIG. 5 using the rail configuration of FIG. 6.

TABLE II

SELF-SWITCHED LAUNCHER FIRING DATA
Estimate of RMS Launch Current Required to Obtain Uniform Exit Velocity for Successive Bores

| Configuration | First Bore Twice Augmented | First Bore Thrice Augmented | First Bore Four Times Augmented |
|---|---|---|---|
| First Bore | 100% | 100% | 100% |
| Second Bore | 74.5 | 79.8 | 83.2 |
| Third Bore | 62.0 | 68.3 | 72.8 |
| Fourth Bore | 54.2 | 60.7 | 65.5 |
| Fifth Bore | 48.8 | 55.2 | 60.0 |

FIG. 7 is a graph of the estimated current flow in a three shot, initially thrice augmented, self switched launcher as shown in FIG. 5. Line segments 134, 136 and 138 illustrate current flow during a projectile launch, while line segments 140 and 142 show the transient current variation between shots with the transient assumed to be completed in 1.5 milliseconds and the firing requiring three milliseconds of acceleration. Again, obtaining the correct sizing of the series external storage inductor may preferably involve a deliberate slight increase in velocity between successive firings. Adjustments during firing are now not practical as once started, the self switched launcher will fire all bores and will then dissipate the remaining inductive energy as ohmic losses. Though not being able to stop firing short of the planned burst number of shots may appear to be a drawback of the self switched launcher, this feature is not seriously detrimental because: the energy for firing is already stored and available; an indication that a target kill was obtained may not arrive early enough to stop such a fast automatic firing sequence; and what is likely to be more important, the reloading mechanism is simplified by being nonselective as it now simply reloads all bores between successive bursts. Thus for both the switched and the self switched launcher configurations, it may be best for simplifying the reloading, to always fire all bores and to then reload all bores during the time interval while the inductor is recharged for a successive burst, assuming that a multiple burst type of operation is required.

One important feature of launchers constructed in accordance with the present invention is that all energy for a burst sequence can be stored in a superconducting inductive storage device, such as a coil which allows essentially indefinitely long storage without significant energy loss, without having high speed rotation of heavy components and without reaction torques produced by rotational equipment during rapid energy discharge. Such an energy storage system may be highly advantageous for a battle tank, and even more so for a satellite, where slow recharging of the superconducting storage could be from a source powered by solar energy. If a launcher is energized from a superconducting inductive energy storage coil, the modes of operation to get a rapid succession of substantially identical muzzle velocity projectiles requires circuitry quite similar to the components for the homopolar-inductor powered launcher which uses a normally conductive inductor. As shown in FIG. 8, a superconducting coil 144, so as to be able to store energy with negligible losses, is shorted through a superconducting link 146 inside a cooled vacuum enclosure 148. To fire a projectile, superconducting link 146 is heated by heater 150 to commutate current into an external firing switch 152 or a suitable alternative switching array, after which the superconducting link is preferably opened. Opening of firing switch 152 commutates current into launcher rails 154 and 156. If augmenting conductors are used, the current in these conductors must be raised to the required firing current level before the first bore firing switch of a multiple bore launcher is opened. Superconducting coil 144 may be recharged by generator 158 through switch 160.

It is estimated that a superconducting inductive storage coil storing 50 megajoules of energy, can be expected to occupy about the same volume as a pulse homopolar machine suitable for transferring about 50 megajoules into a normally conducting inductive pulse coil. Since the latter system additionally requires the inductor coil, the superconducting system will overall be considerably -/ smaller and its weight only about ¼to about ⅓of the homopolar-inductor combination. Although a superconducting energy storage system has been discussed with relation to a launcher constructed in accordance with the present invention, it should be understood that such a pulse energy system is also obviously applicable for single shot firing which can greatly simplify the switching because it allows commutation directly to a low inductance breech if no external augmentation is employed.

The present invention launcher system can store all the energy for a burst firing sequence in an inductor coil and provide for constant muzzle velocity for each projectile in spite of the reduction of driving current, by a commensurate increase in the flux augmentation for successive shots. These launchers must fire very rapidly in order to be efficient and the time between exit of one projectile and commencement of acceleration of the next one should be only in the order of one millisecond. Although particular embodiments of the launcher have been described in great detail, it should be understood that various changes and modifications may be made in these launchers without departing from the scope of this invention. It is therefore intended that the appended claims cover all such changes that fall within the scope of the invention.

What is claimed is:

1. A method of electromagnetically launching a succession of projectiles, comprising the step off:

utilizing a continuation of current flow in a pair of conductive rails which were previously used to launch a projectile, to augment bore flux in a second bore, thereby accelerating a second projectile in said second bore to a greater velocity than would have been achieved without continuation of current flow in said pair of rails.

2. A method of electromagnetically launching a succession of projectiles, comprising the step of:

utilizing a continuation of current flow in conductive rail pairs which have previously launched projectiles, to augment bore flux in not yet fired bores to obtain a substantially constant muzzle velocity for subsequently launched projectiles even though current is decreasing.

3. A method of electromagnetically accelerating projectiles, comprising the steps of:

charging an inductive energy store to a predetermined current level;

switching current from said inductive energy store into a first pair of conductive rails to launch a first projectile;

causing said current to continue flowing in said first pair of rails to augment magnetic flux between a second pair of conductive rails;

connecting said first pair of rails electrically in series with said second pair of rails; and switching current from said inductive energy store into said second pair of rails to launch a second projectile, with current flow in said first pair of rails augmenting flux between said second pair of rails during the launch of said second projectile.

4. The method of claim 3, wherein said switching of current into said second pair of rails is delayed until the current has reached a second predetermined current level.

5. The method of claim 3, further comprising the steps of:

successively continuing current flow in said first and second pairs of rails following the launch of said first and second projectiles; and successively switching current from said inductive energy store into an additional pair of rails to launch an additional projectile, with current flow in the previously fired rails augmenting flux between said additional pair of rails during the launch of said additional projectile.

6. The method of claim 5, wherein said successive switching is delayed until the current has reached a level which will provide substantially the same muzzle velocity for each additional projectile.

7. The method of claim 5, wherein said successive switching of current into said additional pair of rails occurs automatically to launch said additional projectile.

8. An electromagnetic projectile launcher comprising:

a first pair of conductive rails, having a breech end and a muzzle end;

a second pair of conductive rails having a breech end and a muzzle end;

a source of high current;

a first switch for switching current from said high current source to said first pair of rails;

means for conducting current between said first pair of rails and for propelling a first projectile from the breech end to the muzzle end of said first pair of rails;

means for continuing current flow in said first pair of rails following a launch;

means for connecting said second pair of rails electrically in series with said first pair of rails;

a second switch for switching current from said high current source and said first pair of rails to said second pair of rails; and means for conducting current between said second pair of rails and for propelling a second projectile from the breech end to the muzzle end of said second pair of rails;

wherein the rails of said second pair of rails are positioned parallel to and adjacent to said first pair of rails such that current flowing in said first pair of rails augments flux between said second pair of rails.

9. An electromagnetic projectile launcher as recited in claim 8, wherein said second switch is operated after current flow in said first pair of rails has decreased to a predetermined value.

10. An electromagnetic projectile launcher as recited in claim 8, further comprising:

a resistive insert disposed along a portion of an inner surface of at least one of said first pair of rails.

11. An electromagnetic projectile launcher as recited in claim 8, further comprising:

insulation disposed along a portion of an inner surface of at least one of said first pair of rails.

12. An electromagnetic projectile launcher as recited in claim 8, wherein said means for conducting current between said first pair of rails comprises a plasma.

13. An electromagnetic projectile launcher as recited in claim 8, wherein said means for conducting current between said first pair of rails comprises a sliding conductive armature.

14. An electromagnetic projectile launcher as recited in claim 8, wherein said conductive rails are symmetrically disposed about an axis.

15. An electromagnetic projectile launcher as recited in claim 8, wherein said means for continuing current flow in said first pair of rails comprises:

a circuit element electrically connected between the rails of said first pair of rails adjacent to the muzzle end and having a high resistance which changes to a low resistance when subjected to a predetermined voltage.

16. An electromagnetic projectile launcher as recited in claim 15, wherein said circuit element is an arc gap.

17. An electromagnetic projectile launcher as recited in claim 8, further comprising an additional pair of conductive rails.

18. An electromagnetic projectile launcher as recited in claim 17, further comprising an additional means for continuing current flow in said second pair of rails following the launch of said second projectile.

19. An electromagnetic projectile launcher as recited in claim 8, further comprising:

a plurality of augmenting conductors connected in series with said source of high current.

20. An electromagnetic projectile launcher as recited in claim 19, wherein said augmenting conductors inductively store energy to assist in accelerating said first and second projectiles to a predetermined velocity.

21. An electromagnetic projectile launcher as recited in claim 19, wherein said augmenting conductors are symmetrically disposed about an axis.

22. An electromagnetic projectile launcher as recited in claim 8; wherein said source of high current comprises:

an inductive energy storage means.

23. An electromagnetic projectile launcher as recited in claim 22, wherein said inductive energy storage means stores sufficient energy to accelerate said first and second projectiles to a predetermined velocity.

24. An electromagnetic projectile launcher as recited in claim 22, wherein said inductive energy storage means includes superconducting conductors.

25. An electromagnetic projectile launcher as recited in claim 4, further comprising:

means for generating current flow in said superconducting conductors.

26. An electromagnetic projectile launcher comprising:

a first pair of conductors in the form of rails having a breech end and a muzzle end;

a second pair of conductors in the form of rails having a breech end and a muzzle end;

a source of high current;

a switch for switching current from said high current source to said first pair of rails;

means for conducting current between said first pair of rails and for propelling a first projectile from the breech end to the muzzle end of said first pair of rails;

a third pair of conductors electrically connected to said second pair of rails and respectively disposed on opposite sides of said second pair of rails so that current in each one of said second pair of rails and the closest one of said third pair of conductors, flows in the same direction;

means for connecting said first pair of rails in series with said third pair of conductors; and means for conducting current between said second pair of rails and for propelling a second projectile from the breech end to the muzzle end of said second pair of rails;

wherein the rails of said second pair of rails are positioned parallel to and adjacent to said first pair of rails such that current flowing in said first pair of rails augments flux between said second pair of rails.

27. An electromagnetic projectile launcher as recited in claim 26, further comprising:

a resistive insert disposed along a portion of an inner surface of at least one of said first pair of rails.

28. An electromagnetic projectile launcher as recited in claim 26, further comprising:

insulation disposed along a portion of an inner surface of at least one of said first pair of rails.

29. An electromagnetic projectile launcher as recited in claim 26, wherein said means for conducting current between said first pair of rails comprises a plasma.

30. An electromagnetic projectile launcher as recited in claim 26, wherein said means for conducting current between said first pair of rails comprises a sliding conductive armature.

31. An electromagnetic projectile launcher as recited in claim 26, wherein said means for connecting said first pair of rails in series with said third pair of conductors comprises:

a circuit element having a high resistance which changes to a low resistance when suitably triggered.

32. An electromagnetic projectile launcher as recited in claim 31, wherein said circuit element is an arc gap.

33. An electromagnetic projectile launcher as recited in claim 26, further comprising:

an additional pair of conductive rails.

34. An electromagnetic projectile launcher as recited in claim 33, further comprising:

means for continuing current flow in said second pair of rails.

35. An electromagnetic projectile launcher as recited in claim 26, further comprising:

a plurality of augmenting conductors connected in series with said source of high current.

36. An electromagnetic projectile launcher as recited in claim 35, wherein said augmenting conductors inductively store sufficient energy to accelerate said first and second projectiles to a predetermined velocity.

37. An electromagnetic projectile launcher as recited in claim 35, wherein said augmenting conductors are symmetrically disposed about an axis.

38. An electromagnetic projectile launcher as recited in claim 26, wherein said source of high current comprises:

an inductive energy storage means.

39. An electromagnetic projectile launcher as recited in claim 38, wherein said inductive energy storage means stores sufficient energy to accelerate said first and second projectiles to a predetermined velocity.

40. An electromagnetic projectile launcher as recited in claim 38, wherein said inductive energy storage means includes superconducting conductors.

41. An electromagnetic projectile launcher as recited in claim 40, further comprising:

means for generating current flow in said superconducting conductors.

* * * * *